US008150090B2

(12) United States Patent
Ito

(10) Patent No.: US 8,150,090 B2
(45) Date of Patent: Apr. 3, 2012

(54) HEADPHONE AND EAR PAD

(75) Inventor: Tomohiro Ito, Tokyo (JP)

(73) Assignee: Sony Corporation, Tokyo (JP)

( * ) Notice: Subject to any disclaimer, the term of this patent is extended or adjusted under 35 U.S.C. 154(b) by 1036 days.

(21) Appl. No.: 11/983,320

(22) Filed: Nov. 8, 2007

(65) Prior Publication Data

US 2008/0112586 A1 May 15, 2008

(30) Foreign Application Priority Data

Nov. 10, 2006 (JP) ..... P2006-305627

(51) Int. Cl.
*H04R 25/00* (2006.01)

(52) U.S. Cl. ..... 381/371; 381/370; 381/374

(58) Field of Classification Search ..... 381/309, 381/71.6, 370, 371, 374, 381, 372; 181/128, 181/129, 135; 379/430, 431, 432
See application file for complete search history.

(56) References Cited

U.S. PATENT DOCUMENTS

| | | | | |
|---|---|---|---|---|
| 4,027,117 | A | 5/1977 | Nakamura | |
| 4,958,697 | A * | 9/1990 | Moody | 181/129 |
| 5,497,427 | A * | 3/1996 | Nageno | 381/381 |
| 5,996,123 | A | 12/1999 | Leight et al. | |
| 2006/0188121 | A1 * | 8/2006 | Tsunoda | 381/374 |
| 2006/0239491 | A1 | 10/2006 | Ito | |

FOREIGN PATENT DOCUMENTS

| | | |
|---|---|---|
| EP | 0 583 900 | 2/1994 |
| EP | 0 895 439 | 2/1999 |
| JP | 48-12721 | 2/1973 |
| JP | 63-232797 | 9/1988 |
| JP | 63-268395 | 11/1988 |
| JP | 3-227200 | 10/1991 |
| JP | 6-78386 | 3/1994 |
| JP | 8 307986 | 11/1996 |
| JP | 2001 112081 | 4/2001 |

OTHER PUBLICATIONS

Office Action issued in corresponding Chinese application No. 200710170341.3.

* cited by examiner

*Primary Examiner* — Huyen D Le
(74) *Attorney, Agent, or Firm* — Frommer Lawrence & Haug LLP; William S. Frommer; Thomas F. Presson

(57) ABSTRACT

The present invention provides a headphone with a more comfortable and stable feeling to the user when being worn by the user. The headphone includes a headphone section that has a sound-sending section of a speaker unit arranged at the front surface side thereof, and has its rear surface side covered by a housing, and an ear pad that covers the sound-sending section of the speaker unit. In the ear pad, a porous elastic body of low repulsion is covered by a pad cover.

5 Claims, 14 Drawing Sheets

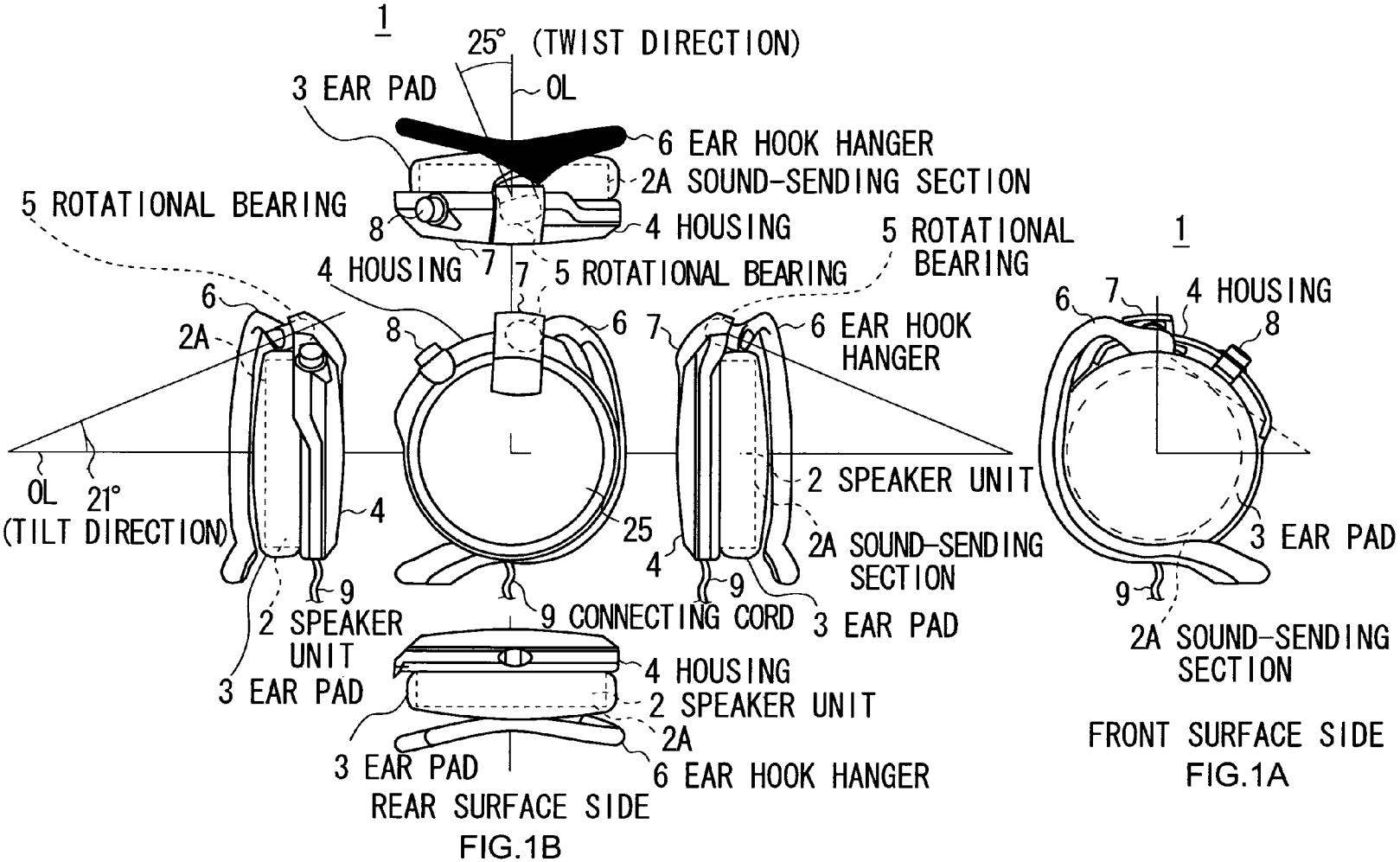
1
4 HOUSING
8
3 EAR PAD
2A SOUND-SENDING SECTION
9
6
7
FRONT SURFACE SIDE
FIG.1A
1
25° (TWIST DIRECTION)
OL
6 EAR HOOK HANGER
2A SOUND-SENDING SECTION
4 HOUSING
5 ROTATIONAL BEARING
3 EAR PAD
5 ROTATIONAL BEARING
7
8
4 HOUSING
6 EAR HOOK HANGER
2 SPEAKER UNIT
2A SOUND-SENDING SECTION
3 EAR PAD
9 CONNECTING CORD
25
4
2A
6
9
2A
5 ROTATIONAL BEARING
21° (TILT DIRECTION)
OL
4 HOUSING
2 SPEAKER UNIT
6 EAR HOOK HANGER
3 EAR PAD
REAR SURFACE SIDE
FIG.1B

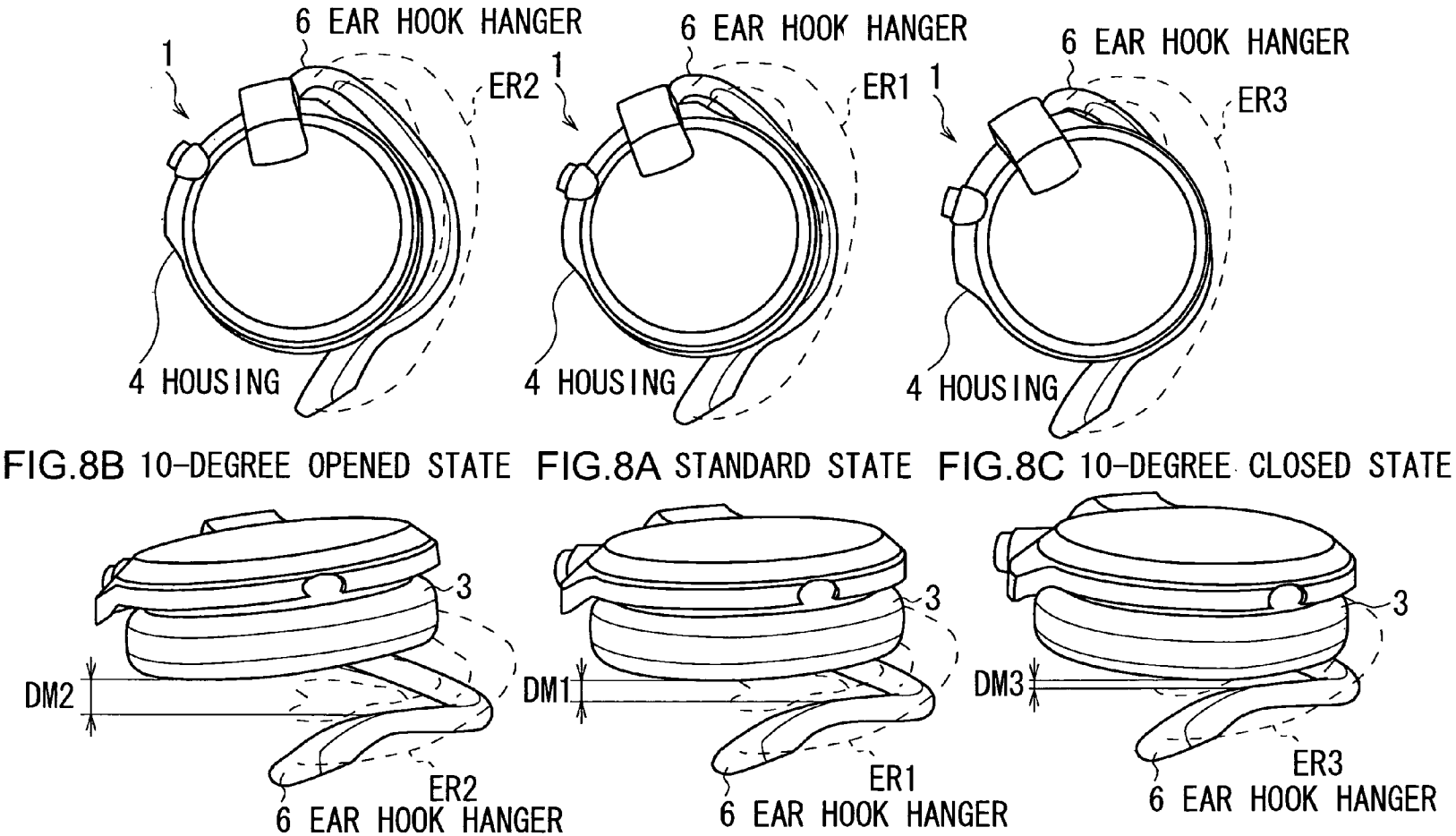
FIG.8B 10-DEGREE OPENED STATE FIG.8A STANDARD STATE FIG.8C 10-DEGREE CLOSED STATE

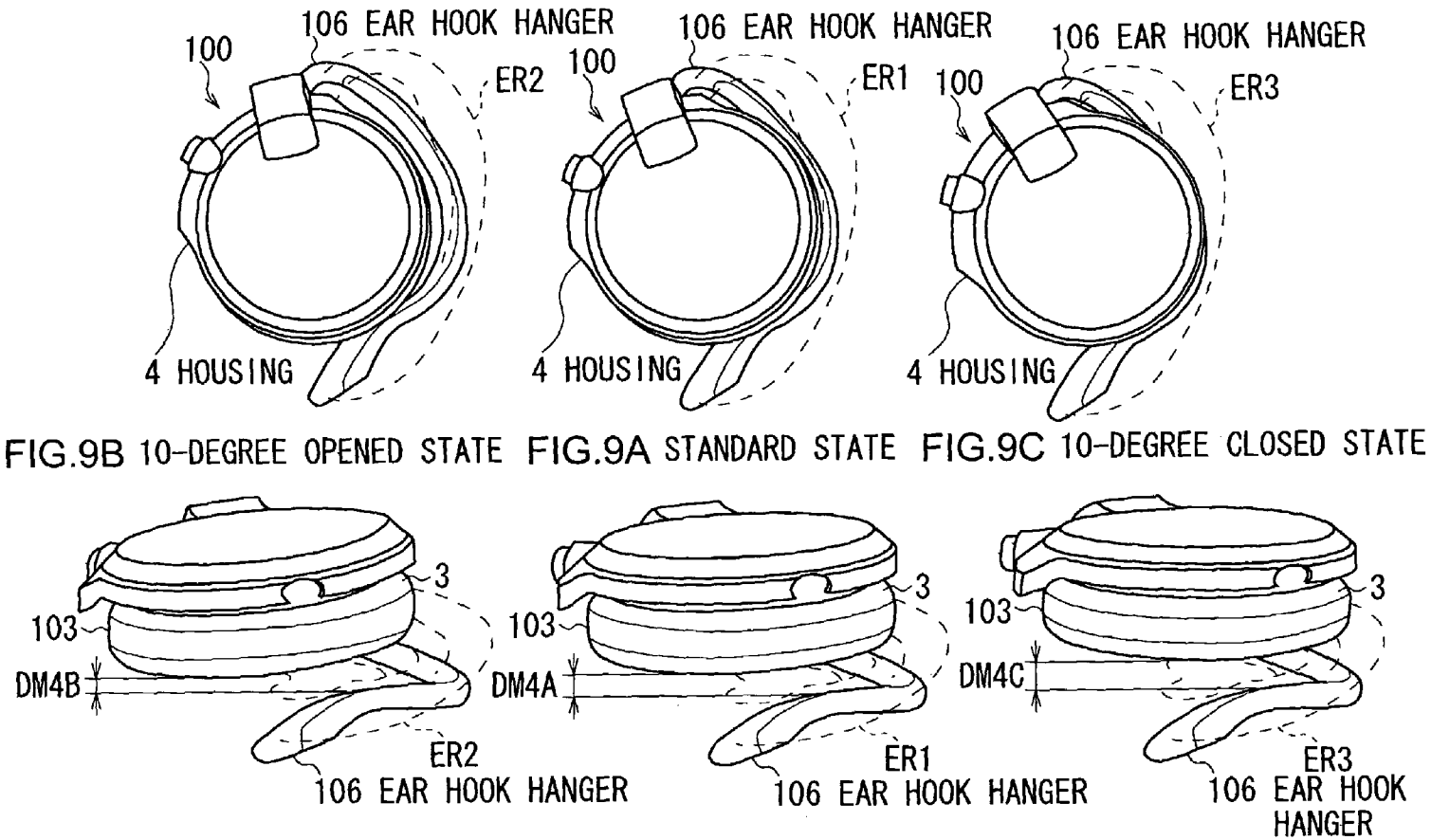
FIG.9B 10-DEGREE OPENED STATE FIG.9A STANDARD STATE FIG.9C 10-DEGREE CLOSED STATE

HEADPHONE AND EAR PAD

CROSS REFERENCES TO RELATED APPLICATIONS

The present invention contains subject matter related to Japanese Patent Application JP2006-305627 filed in the Japanese Patent Office on Nov. 10, 2006, the entire contents of which being incorporated herein by reference.

BACKGROUND OF THE INVENTION

1. Field of the Invention

The present invention relates to a headphone and an ear pad which are desirably applied to a headphone of the behind-the-ear fixing type used for such as a portable music player, for example.

2. Description of the Related Art

Since a headphone of the behind-the-ear fixing type (hanger-ear type) is of a configuration in which an ear hook hanger and a headphone section having a speaker unit built therein sandwich a soft ear of a person, and the weight of the headphone section itself is supported to be attached to the ear, it is significantly difficult to attach the headphone of this fixing type to the right and left ears stably (for example, refer to Patent Document 1: Jpn. Pat. Appln. Laid-Open Publication No. 2001-112081).

This hanger-ear type headphone is not of the sound-isolating type which covers the right and left ears but of the open-air type, which is generally used as a light type headphone giving an opened feeling and producing a pure sound, and is often used for the out door use.

As the external appearance characteristics of the open-air type, as is referred to as the open-air, the opened area at the front surface as well as that at the rear surface of the speaker unit is made large as much as possible so as to improve the air permeability.

On the other hand, generally, in the sound-isolating type, the front surface of the speaker unit is provided with a sewn fun fur or a deposited ear pad suppressing the air permeability, while the rear surface is covered by a housing in the form of a dome.

An ear pad, which is one part of acoustic adjustment parts, is an important element to disperse a pressure to the skin and give a comfortable feeling when a headphone is fixed to the user. To give greater importance to make the user feel light when the headphone is fixed to the user, the hanger-ear type headphone of the open-air type has to make the lateral pressure small.

In the past, while two pieces of urethane foam of the ester series, which can be deposited, have their outer circumferences deposited, or urethane foam of the ether series which is bored by a heat ray is used, there is raised a problem of the repulsion force of an ear pad in matching the ear pad to ears of various figurations due to the differences among individuals, which makes it difficult to satisfy all the users when the ear pad is fixed to the users.

Especially, while the hanger-ear type headphone is general as a category which is simple and convenient, and is provided with the fashionability, the headphone does not have a headband, which makes the lateral pressure to make the ear pad in close contact with the ear small, and does not have a hook to the ear hole which is provided in the inner-ear type.

Under the method of fixing the hanger-ear type headphone, since an ear hook hanger and a headphone section having a speaker unit built therein sandwich a soft ear, and the weight of the headphone section itself is supported to be attached to the ear, it is significantly difficult to attach the headphone of this fixing type to the right and left ears stably.

SUMMARY OF THE INVENTION

Meanwhile, in thus configured hanger-ear type headphone, since the lateral pressure is small as the headphone does not have a headband, the headphone section is released from an ear even by a slight repulsion force, which does not match the ear pad to the concavity and convexity of the ear, raising a problem of giving an uncomfortable feeling and an unstable feeling to the user when the headphone is fixed to the user.

Among headphones of higher classes, there are some in which urethane foam of low repulsion is arranged at the inside of an ear pad using a sewn fun fur. On the other hand, in a small space in the form of a ring of substantially one ear at the headphone section, since the hardness of the surface of the cloth of the sewn fun fur is much larger than the repulsion force of the low repulsion urethane foam, there is little effect produced when the low repulsion urethane foam is used, and furthermore, there is raised restriction in enlarging the thickness of the low repulsion urethane foam due to the necessity of making the ear pad get close to the speaker unit being the sound source as much as possible as well as preventing a sound from leaking. Accordingly, there is raised a problem that a comfortable feeling is not necessarily given to the user when the headphone is fixed to the user.

In view of the above-identified circumstances, it is therefore desirable to provide an excellent headphone and an excellent ear pad which can give a more comfortable feeling and a more stable feeling to the user when being fixed to the user as compared with that in the past.

According to an embodiment of the present invention, there is provided a headphone including: a headphone section that has a sound-sending section of a speaker unit arranged at the front surface side thereof, and has its rear surface side covered by a housing; and an ear pad that covers the sound-sending section of the speaker unit; wherein, in the ear pad, a porous elastic body of low repulsion is covered by a pad cover.

According to an embodiment of the present invention, there is also provided an ear pad including: a porous elastic body of low repulsion in the form of a ring which is provided with a hole at the center thereof; and a pad cover that covers the porous elastic body of low repulsion; wherein the pad cover includes a polyurethane foam for which the continuous bubble processing has been performed and a cloth, and the cloth is attached to the front side thereof which abuts on a ear of the user.

According to the present invention, since there is provided a headphone which includes a headphone section that has a sound-sending section of a speaker unit arranged at the front surface side thereof, and has its rear surface side covered by a housing, and an ear pad that covers the sound-sending section of the speaker unit, wherein, in the ear pad, a porous elastic body of low repulsion is covered by a pad cover, the porous elastic body of low repulsion is made to abut on an ear of the user through the pad cover, and the porous elastic body of low repulsion can be matched to the figuration of the ear, which can give a more comfortable feeling and a more stable feeling to the user when the headphone is fixed to the user, and can realize an excellent headphone which can give a more comfortable feeling and a more stable feeling to the user when being fixed to the user as compared with that in the past.

According to the present invention, since there is also provided an ear pad which includes a porous elastic body of low repulsion in the form of a ring which is provided with a hole at the center thereof, and a pad cover that covers the porous elastic body of low repulsion, wherein the pad cover includes a polyurethane foam for which the continuous bubble processing has been performed and a cloth, and the cloth is attached to the front side thereof which abuts on a ear of the user, the porous elastic body of low repulsion is made to abut on an ear of the user through the cloth, and the porous elastic body of low repulsion can be matched to the figuration of the ear, which can give a more comfortable feeling and a more stable feeling to the user when the ear pad is fixed to the user, and can realize an excellent ear pad which can give a more comfortable feeling and a more stable feeling to the user when being fixed to the user as compared with that in the past.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIG. 1A and FIG. 1B show schematic views indicative of the configuration of a headphone main body section of the hanger-ear type according to the first embodiment;

FIG. 8A to FIG. 8C show schematic views indicative of the change of the fixed state of the left side headphone main body section with its axis inclined in two directions according to an embodiment of the present invention when fixed to users of different ear sizes;

FIG. 9A to FIG. 9C show schematic views indicative of the change of the fixed state of a left side headphone main body section with its axis inclined in one direction when fixed to users of different ear sizes;

DETAILED DESCRIPTION OF THE PREFERRED EMBODIMENTS

Figure 2:
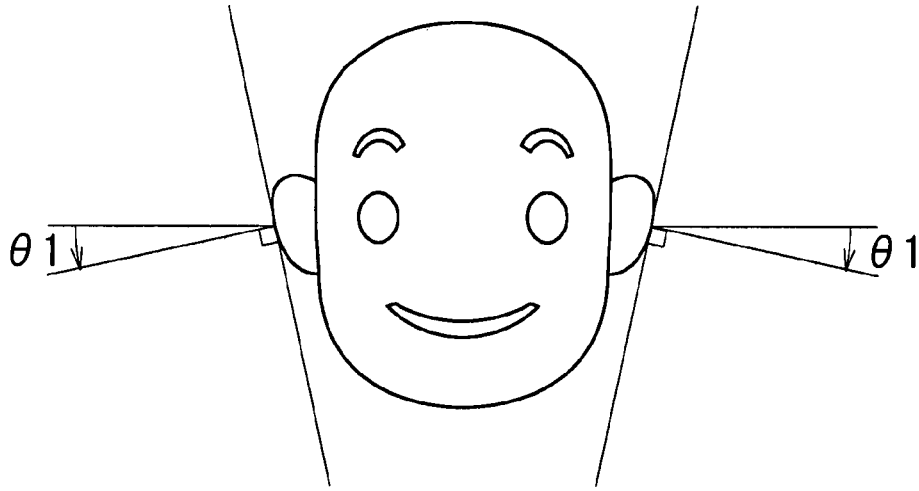
FIG. 2 shows a schematic view indicative of an inclination angle in the tilt direction.

Now, embodiments of the present invention will be described in greater detail by referring to the accompanying drawings.

(1) First Embodiment (1-1) External Appearance Configuration of a Headphone Main Body Section in the First Embodiment In FIG. 1A and FIG. 1B, a reference numeral "1" represents a left side headphone main body section to be fixed to a left ear configuring a headphone of the hanger-ear type according to the first embodiment. As the entire headphone, a right side headphone main body section to be fixed to a right ear, not shown, and the left side headphone main body section 1 which are of the same configuration and symmetric with each other are connected by a connecting cord 9.

The left side headphone main body section 1 has a sound-sending section 2A of a speaker unit 2 arranged at the front surface side thereof, and the sound-sending section 2A is covered by an ear pad 3 in the state of sponge, and has its rear surface side covered by a housing 4.

The housing 4 has a cord-reeling mechanism built therein, not shown, to reel up the connecting cord 9, and, when a reel button 8 is pressed, the cord-reeling mechanism reels up the connecting cord 9 to the inside of the housing 4.

To the housing 4, at the upper center thereof, an ear hook hanger 6 made of synthetic resin etc. being an elastic body is pivotally attached through a rotational bearing 5 which is arranged at a quadrant of the sound-sending section 2A side of the speaker unit 2. The rotational bearing 5 is covered by a rotational bearing cover 7.

The ear hook hanger 6 has its entire arm section set rounded so as to correspond with the figuration of an ear, and, when viewing the left side headphone main body section 1 from the front side at the time of being fixed to the user (FIG. 1B, left side view), the ear hook hanger 6 is attached to the rotational bearing 5 with an inclination of approximately 21 degrees formed in the tilt direction with respect to the normal line OL of the housing 4 passing through the center thereof.

The tilt direction is a direction which indicates, as shown in FIG. 2, when viewing a face of the user from the front side, at what angles an ear is located with respect to the face, and is represented by an inclination angle θ1. Accordingly, being attached to the housing 4 through the rotational bearing 5 with an inclination of approximately 21 degrees formed in the tilt direction, when the ear hook hanger 6 is fixed to an ear of the user, the arm section is set along the tilt direction of the ear, which gives a comfortable feeling to the user when the left side headphone main body section 1 is fixed to the user.

The inclination angle θ1 in the tilt direction is set to approximately 21 degrees since, after the questionnaire result by a plurality of users, the large majority of the users consider that the inclination angle θ1 in the tilt direction of 21 degrees gives a comfortable feeling to the users.

Furthermore, when viewing the left side headphone main body section 1 from the top side (FIG. 1B, top view), the ear hook hanger 6 is attached to the rotational bearing 5 with an inclination of approximately 25 degrees formed in the twist direction with respect to the normal line OL of the housing 4 passing through the center thereof.

Figure 3:
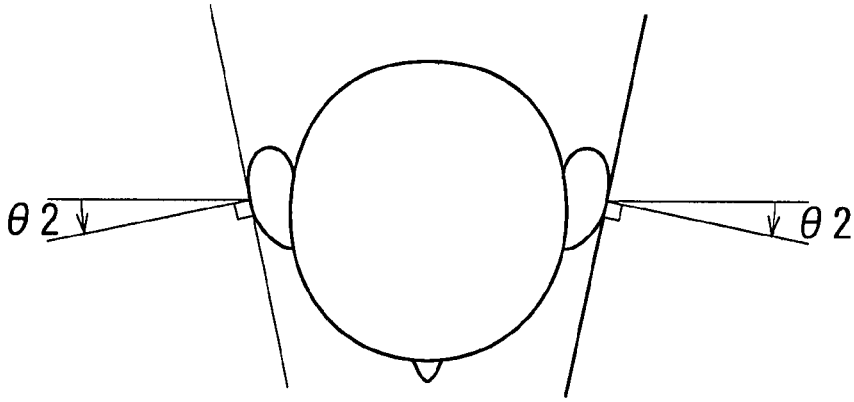
FIG. 3 shows a schematic view indicative of an inclination angle in the twist direction.

The twist direction is a direction which indicates, as shown in FIG. 3, when viewing a face of the user from the top side, at what angles an ear of the user is located with respect to the face, and is represented by an inclination angle θ2. Accordingly, being attached to the housing 4 through the rotational bearing 5 with an inclination of approximately 25 degrees formed in the twist direction, when the ear hook hanger 6 is fixed to an ear of the user, the arm section is set along the twist direction of the ear, which gives a comfortable feeling to the user when the left side headphone main body section 1 is fixed to the user.

Figure 4:
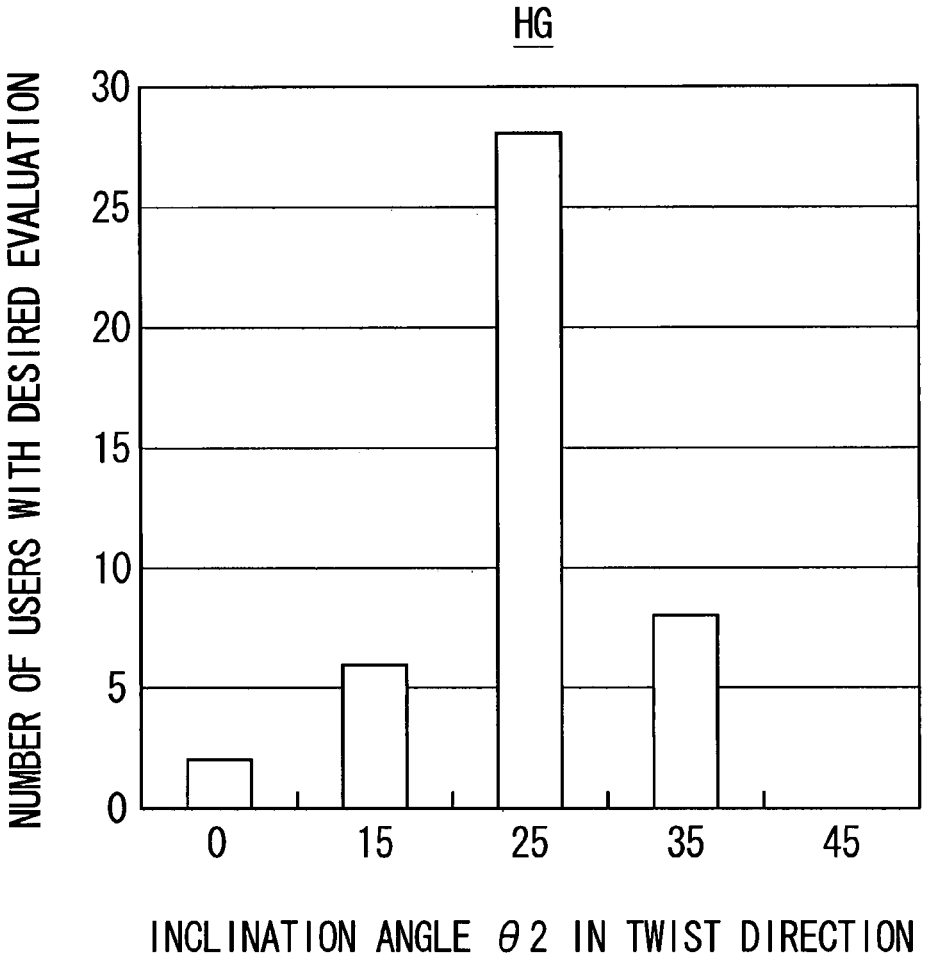
FIG. 4 shows a graph indicative of a histogram of an inclination angle in the twist direction.

When the ear hook hanger 6 is attached to the rotational bearing 5, the inclination angle θ2 in the twist direction is set to approximately 25 degrees since, after the questionnaire result by a plurality of users for the inclination angle in the twist direction of 0 degree, 15 degrees, 25 degrees, 35 degrees, and 45 degrees, based on a histogram HG for the respective inclination angles being the counting result shown in FIG. 4, the large majority of the users consider that the inclination angle θ2 in the twist direction of 25 degrees gives a comfortable feeling to the users.

Being attached to the housing 4 through the rotational bearing 5 with an inclination of approximately 21 degrees in the tilt direction as well as with an inclination of approximately 25 degrees in the twist direction, the ear hook hanger 6 has its arm section set along the tilt direction as well as along the twist direction of the ear, which gives a more comfortable fitted feeling to the user as compared with an ear hook hanger which is attached with an inclination formed only in the tilt direction.

(1-2) Internal Configuration of the Left Side Headphone Main Body Section in the First Embodiment Next, the internal configuration of the left side headphone main body section 1 will be described with reference to FIG. 5. Respective members configuring the left side headphone main body section 1 are made of synthetic resin, corrosive-resistant metal, etc.

Actually, at the inside of the left side headphone main body section 1, an enclosure 22 substantially in the form of a cylinder is arranged, and to the inner circumference side of an upper side retention section 22A of the enclosure 22, a wind-up reel 23 that reels up the connecting cord 9 is attached through a central axis 22C.

To the enclosure 22 in which the wind-up reel 23 is arranged, a reel cover 24 is so attached on the wind-up reel 23 as to cover the enclosure 22, and, to the reel cover 24, a face cap 25 and the rotational bearing cover 7 are concurrently attached.

Furthermore, in the left side headphone main body section 1, to the inner circumference side of a lower side retention section 22B in the form of a flange which is arranged at the lower side of the enclosure 22, the speaker unit 2 in the form of a low circular cylinder is fitted to be attached. Part where the wind-up reel 23, reel cover 24, face cap 25, and speaker unit 2 are attached to the enclosure 22 is referred to as a headphone section 29.

In the left side headphone main body section 1, with respect to the rotational bearing 5 arranged on the circumferential end section of the lower side retention section 22B of the enclosure 22 in the headphone section 29, an axis retention section 6A arranged at the leading end of the ear hook hanger 6 is supported by a rotation axis 26 in the form of a screw, and the rotation axis 26 is covered by an axis cover 27.

Figure 5:
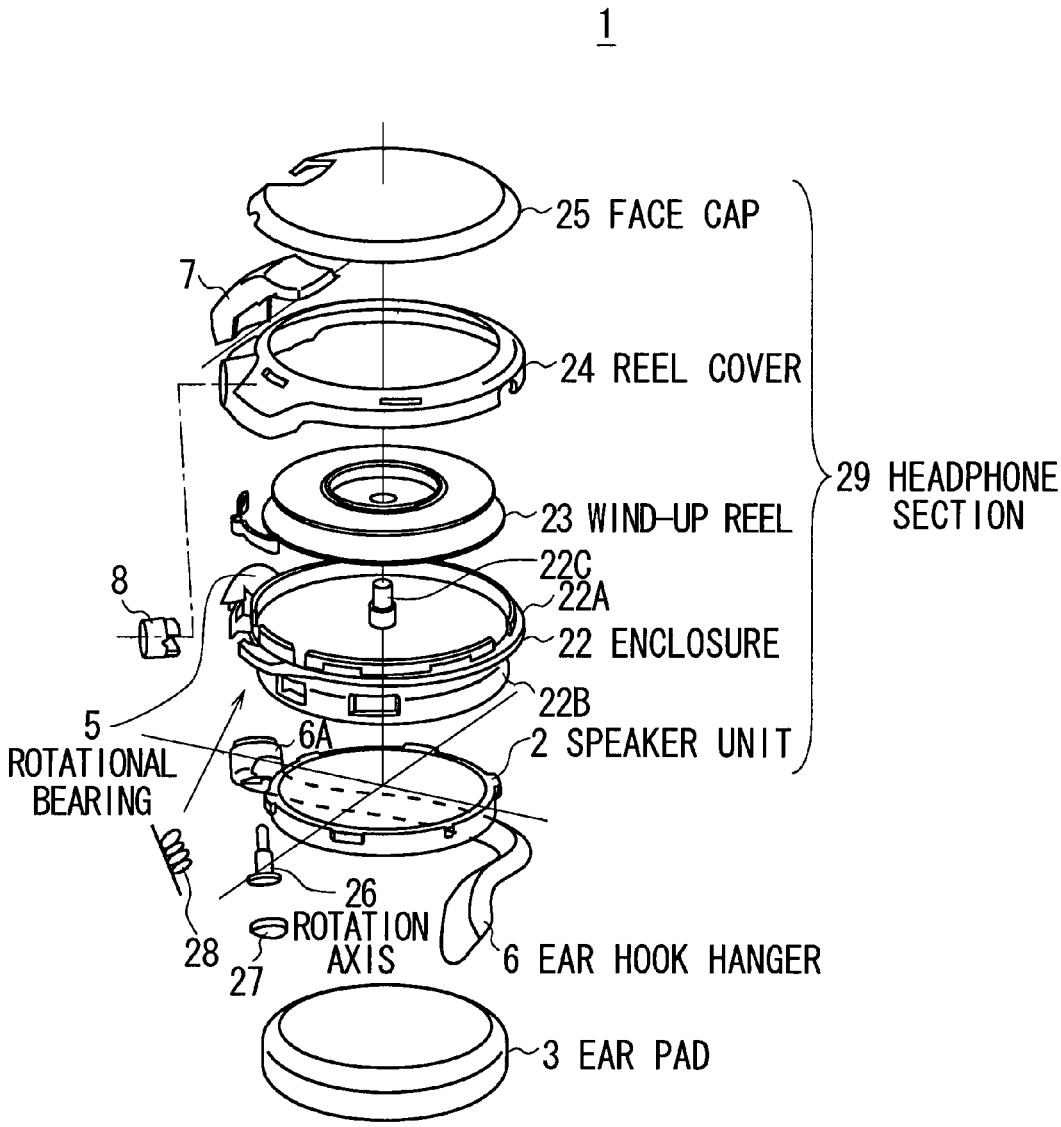
FIG. 5 shows a perspective view indicative of the internal configuration of a left side headphone main body section.

In FIG. 5, while the ear hook hanger 6 and speaker unit 2 are overlapped, the ear hook hanger 6 and speaker unit 2 are separate and independent parts, and, since the ear hook hanger 6 is attached to the rotational bearing 5 of the enclosure 22, only the ear hook hanger 6 can pivot through the rotation axis 26 of the rotational bearing 5 independently from the speaker unit 2.

In the left side headphone main body section 1, the axis retention section 6A of the ear hook hanger 6 is supported by the rotational bearing 5 with a spring 28 attached to the rotation axis 26. Accordingly, when the ear hook hanger 6 is made to pivot through the rotational bearing 5, due to the biasing force of the spring 28, a force to return the arm section of the ear hook hanger 6 to the original position (FIG. 1) is brought about.

The force to return the arm section of the ear hook hanger 6 to the original position works to sandwich an ear of the user between the surface of the ear pad 3 abutting on the ear of the user and the arm section of the ear hook hanger 6, and tightly retain the arm section of the ear hook hanger 6 with respect to the ear like an ear-hook part of glasses.

As described above, in the left side headphone main body section 1, the ear hook hanger 6 is attached to the housing 4 through the rotational bearing 5 with an inclination of approximately 21 degrees in the tilt direction as well as with an inclination of approximately 25 degrees in the twist direction. This is because the rotational bearing 5 itself is arranged on the enclosure 22 with an inclination of approximately 21 degrees in the tilt direction as well as with an inclination of approximately 25 degrees in the twist direction.

Accordingly, in the left side headphone main body section 1, when the ear hook hanger 6 is supported by the rotational bearing 5 of the headphone section 29, and is made to pivot against the biasing force of the spring 28, at a quadrant of the sound-sending section 2A side of the speaker unit 2, the arm section of the ear hook hanger 6 can be made to pivot within a predetermined pivot angle range with a three-dimensional virtual axis line (rotation axis 26), which is formed by inclining the ear hook hanger 6 in two directions or in the tilt direction by approximately 21 degrees as well as in the twist direction by approximately 25 degrees, being the pivot axis.

(1-3) Fixing State in the First Embodiment

Figure 6A:
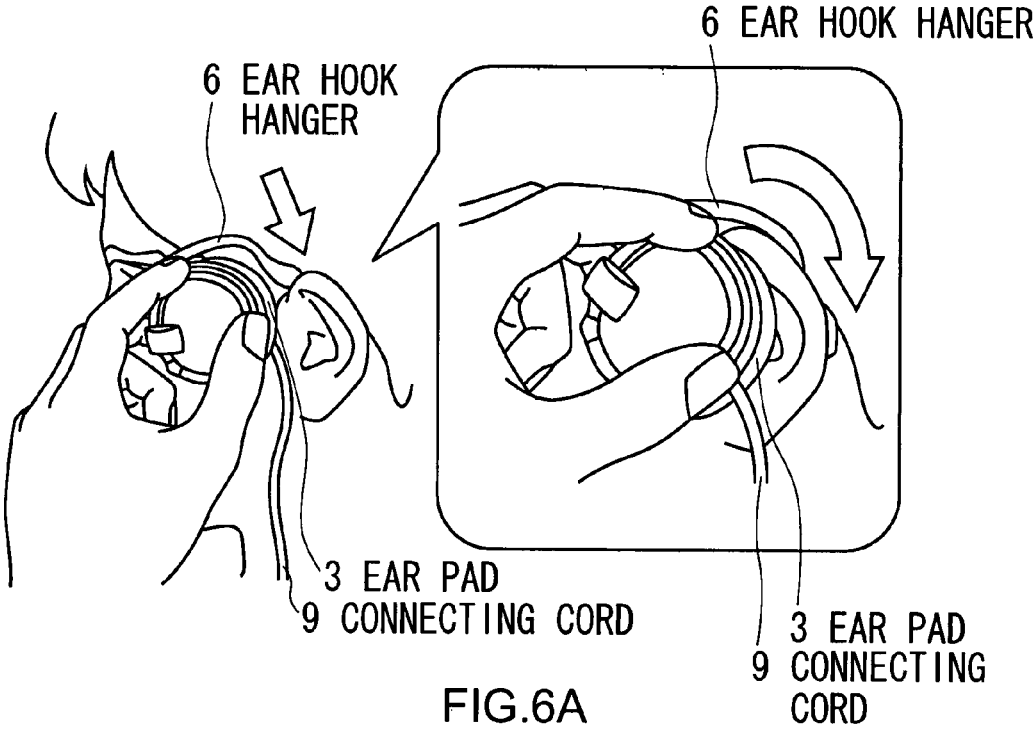
FIG. 6A and FIG. 6B show perspective views to describe the manner of fixing the left side headphone main body section.
Figure 6B:
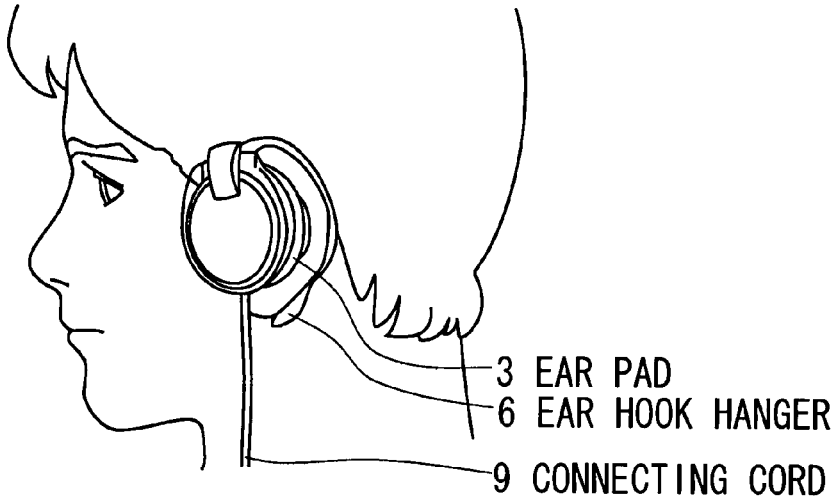
Figure 7:
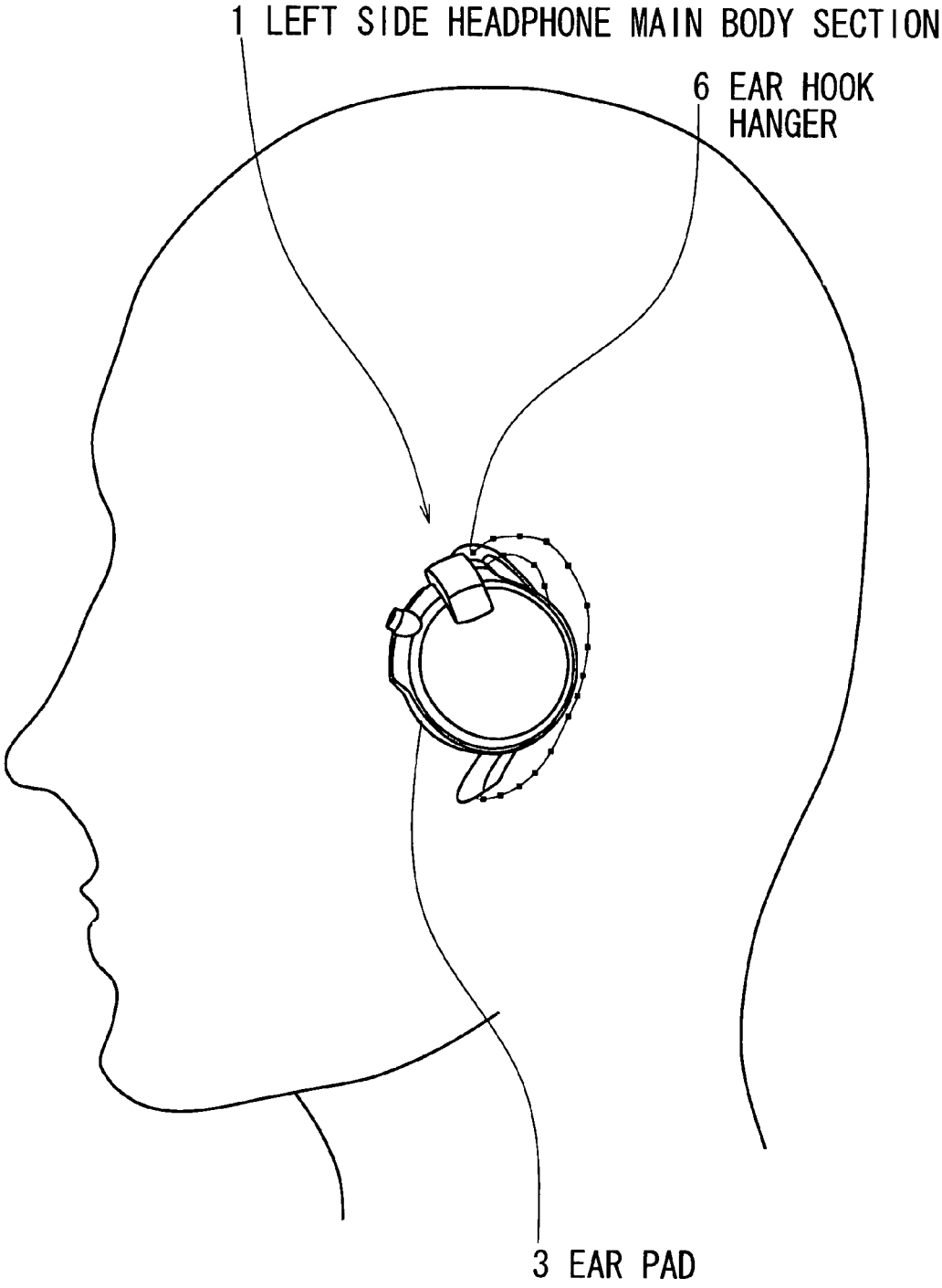
FIG. 7 shows a schematic view indicative of the fixed state of the left side headphone main body section.

When the left side headphone main body section 1 having above-described ear hook hanger 6 whose axis is inclined in two directions is fixed to an ear of the user, as shown in FIG. 6A and FIG. 6A, the leading end of the arm section of the ear hook hanger 6 is put in to be set to the base of the ear as if the user puts on glasses. Accordingly, as shown in FIG. 7, the left side headphone main body section 1 is retained with the ear pad 3 made to abut on the concha auriculae, and concurrently with the arm section of the ear hook hanger 6 hooked by the ear, that is, consequently, with the ear sandwiched between the ear pad 3 and the arm section of the ear hook hanger 6.

The difference of the fixing state between a case in which the left side headphone main body section 1 having the ear hook hanger 6 whose axis is inclined in two directions or in the tilt direction and in the twist direction according to an embodiment of the present invention is fixed to the user and a case in which the basic structure is not changed and a left side headphone main body section having an ear hook hanger whose axis is inclined in only one direction or in the tilt direction is fixed to the user will be described with reference to FIG. 8A to FIG. 8C and FIG. 9A to FIG. 9C.

In case the left side headphone main body section 1 having the ear hook hanger 6 whose axis is inclined in two directions or in the tilt direction and in the twist direction according to an embodiment of the present invention is fixed to the user, as shown in FIG. 8A, with respect to a user who has an ear ER1 with the standard thickness, the pivot angle of the ear hook hanger 6 through the rotational bearing 5 is in the standard state. On the other hand, as shown in FIG. 8B, with respect to a user who has an ear ER2 with a thickness larger than the standard thickness, the pivot angle of the ear hook hanger 6 through the rotational bearing 5 is in the 10-degree opened state which is larger than the standard state by 10 degrees, while, as shown in FIG. 8C, with respect to a user who has an ear ER3 with a thickness smaller than the standard thickness, the pivot angle of the ear hook hanger 6 through the rotational bearing 5 is in the 10-degree closed state which is smaller than the standard state by 10 degrees.

That is, in the left side headphone main body section 1 according to an embodiment of the present invention, even if the pivot angle of the ear hook hanger 6 is in any one of the standard state (FIG. 8A), 10-degree opened state (FIG. 8B), and 10-degree closed state (FIG. 8C), distances DM1 to DM3 from the surface of the ear pad 3 to the arm section of the ear hook hanger 6 are changed according to the thicknesses of the ears ER1 to ear ER3 with the arm section of the ear hook hanger 6 kept parallel with respect to the surface of the ear pad 3.

Accordingly, in the left side headphone main body section 1 according to an embodiment of the present invention, as the pivot angle of the ear hook hanger 6 changes, the distances DM1 to DM3 from the surface of the ear pad 3 to the arm section of the ear hook hanger 6 are changed, while the arm section of the ear hook hanger 6 is kept parallel with respect to the surface of the ear pad 3. Accordingly, even if the thicknesses of the ears ER1 to ear ER3 of the respective users are different from each other, a comfortable feeling and a stable feeling can be given to all the users when the left side headphone main body section 1 is fixed to the users.

On the other hand, as shown in FIG. 9A to FIG. 9C in which parts or components similar to those shown in FIG. 8A to FIG. 8C are indicated with the same reference numerals, in case a left side headphone main body section 100 having an ear hook hanger 106 whose axis is inclined in only one direction or in the tilt direction is fixed to the user, with respect to a user who has the ear ER1 with the standard thickness, the pivot angle of the ear hook hanger 106 is in the standard state (FIG. 9A). On the other hand, with respect to a user who has the ear ER2 with a thickness larger than the standard thickness, the pivot angle of the ear hook hanger 106 is in the 10-degree opened state which is larger than the standard state by 10 degrees (FIG. 9B), while with respect to a user who has the ear ER3 with a thickness smaller than the standard thickness, the pivot angle of the ear hook hanger 106 is in the 10-degree closed state which is smaller than the standard state by 10 degrees (FIG. 9C).

Meanwhile, in the left side headphone main body section 100 having an ear hook hanger 106 whose axis is inclined in only one direction or in the tilt direction, even if the pivot angle of the ear hook hanger 106 is in any one of the standard state (FIG. 9A), 10-degree opened state (FIG. 9B), and 10-degree closed state (FIG. 9C), distances DM4A to DM4C from the surface of the ear pad 103 to the arm section of the ear hook hanger 106 are scarcely changed, and the arm section of the ear hook hanger 106 is not necessarily kept parallel with respect to the surface of the ear pad 103.

Accordingly, in the left side headphone main body section 100 having the ear hook hanger 106 whose axis is inclined in only one direction or in the tilt direction, even if the pivot angle of the ear hook hanger 106 changes, the distances DM4A to DM4C from the surface of the ear pad 103 to the arm section of the ear hook hanger 106 are scarcely changed. Accordingly, with respect to a user who has the ear ER2 with a thickness larger than the standard thickness and a user who has the ear ER3 with a thickness smaller than the standard thickness, not only a comfortable feeling is not given when the left side headphone main body section 100 is fixed to the users, but also the positional relationship between the ear pad 103 and the concha auriculae is changed from the optimum condition as the pivot angle of the ear hook hanger 106 becomes large.

(1-4) Configuration of the Ear Pad in the First Embodiment

The ear pad 3 of the left side headphone main body section 1 having the ear hook hanger 6 whose axis is inclined in two directions is devised, which is not performed in the past, and this point will be described next.

Figure 10A:
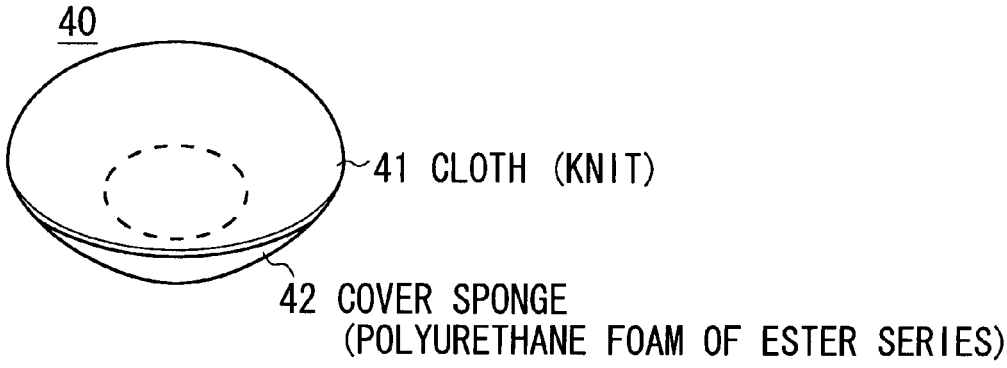
FIG. 10A and FIG. 10B show perspective views indicative of the configuration of a pad cover of an ear pad.
Figure 10B:
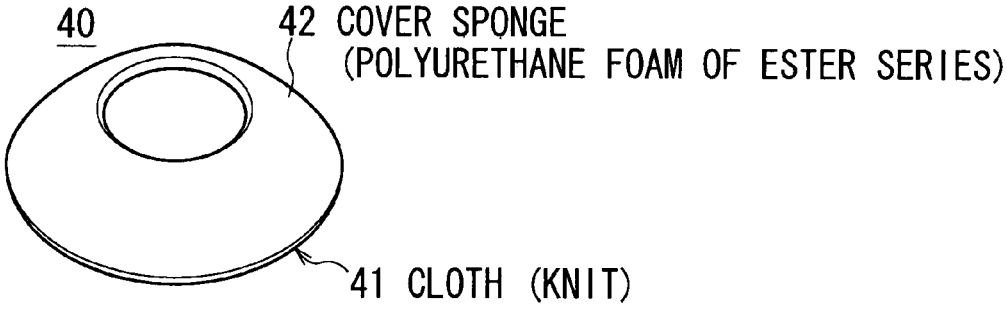
Figure 11:
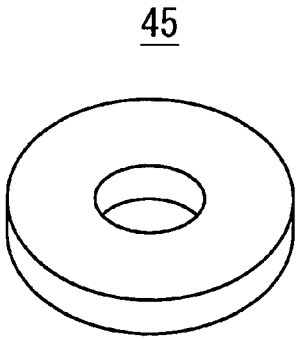
FIG. 11 shows a perspective view indicative of the configuration of an internal sponge (low repulsion urethane foam) of the ear pad.

The ear pad 3 is configured by a pad cover 40 shown in FIG. 10A and FIG. 10B and an internal sponge 45 being a porous elastic body made of urethane foam of low repulsion shown in FIG. 11 which is arranged at the inside of the pad cover 40.

The pad cover 40 has arranged at the front side thereof, to be made to abut on an ear of the user, a stretchable cloth 41 (FIG. 10A) made of synthetic resin fabric such as nylon, polyester, etc. as flexible material in the state of knit which is provided with the high air permeability and high sound permeability, and has arranged at the rear side thereof, enveloping the speaker unit 2, a cover sponge 42 (FIG. 10B) being an elastic body made of polyurethane foam of the ester series in the form of a ring provided with a communication opening which covers the side surface of the internal sponge 45 for which the continuous bubble processing has been performed, and the cloth 41 and cover sponge 42 have their mutual ends of joining areas deposited by heat.

On the other hand, the internal sponge 45 is made of the low repulsion urethane foam in the form of a ring for which the continuous bubble processing has not been performed, which has its size made slightly smaller than the size of the cover sponge 42 so as to be stored at the inside of the cover sponge 42. While the cloth 41 and cover sponge 42 have their mutual ends of joining areas deposited by heat as necessary, the internal sponge 45 may be deposited by heat to be fixed to the cover sponge 42 of the pad cover 40.

The low repulsion urethane foam employed as the material for the internal sponge 45 is used for seats of a space shuttle of NASA, and has been developed to ease the burden of long-term seat works under large strain and vibrations which are cruel for astronauts, and is provided with the characteristics of load dispersion and low repulsion.

While urethane foam which is used for general furniture is approximately 15 to 30 kg/m$^3$ in density, the low repulsion urethane foam is approximately 65 kg/M$^3$ in density, which is two or three times the density of the general urethane foam. The criterion of the low repulsion is that the ball drop resilience is 20% or less when the density is approximately 40 kg/m$^3$ or more.

In general, due to the difference from the general urethane foam in density, the low repulsion urethane foam is provided with the characteristics of being transformed slowly with respect to an external pressure as well as recovering slowly, and dispersing a load to provide a comfortable nonsticky feeling without a sensation of pressure, and can be used indefinitely with little fatigue.

Figure 12:
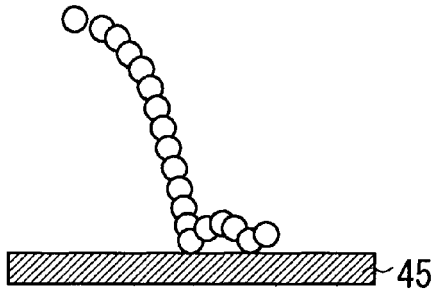
FIG. 12 shows a schematic view to describe the boundless property.

The low repulsion urethane foam used for the internal sponge 45 is a polyurethane foam for cushion provided with the boundless property, as shown in FIG. 12, and is provided with a small ball drop resilience, which does not make the user feel tired at the time of use for a long time period since the body pressure is evenly dispersed when used for cushion material, and is provided with a large shock absorption, and the temperature dependence in hardness, which makes the low repulsion urethane foam hard when the temperature is low and soft when the temperature is high.

Figure 13:
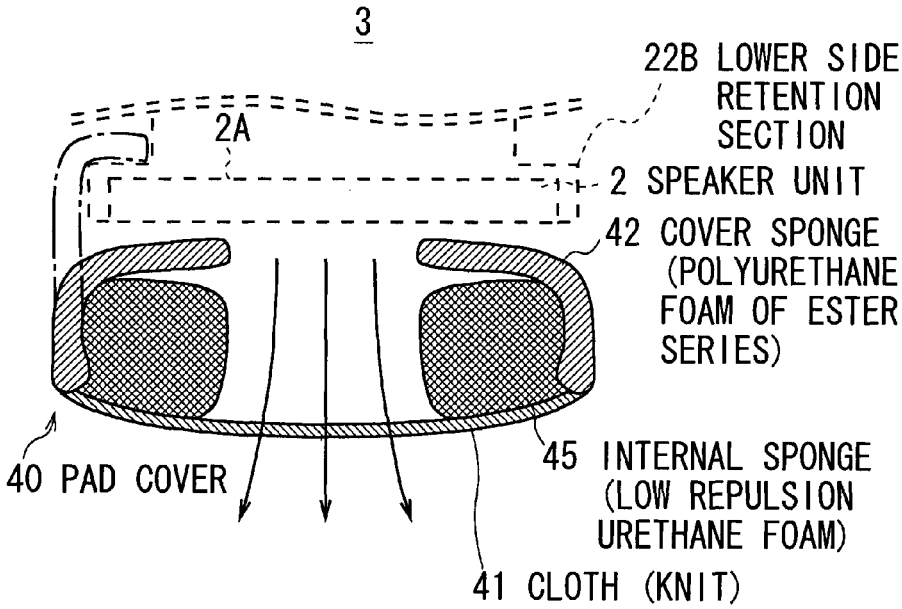
FIG. 13 shows a cross-sectional view indicative of the cross-sectional configuration of the ear pad.

As shown in FIG. 13, the ear pad 3 is configured such that, in the pad cover 40 (cover sponge 42) in the form of a ring provided with a hole, the internal sponge 45 in the form of a ring provided with a hole of approximately the same size is stored, and the cover sponge 42 of the pad cover 40 is hooked by a flange section of the lower side retention section 22B in the form of a flange of the enclosure 22.

Meanwhile, the cover sponge 42 used for the pad cover 40 of the ear pad 3, which is made of material for which the continuous bubble processing has been performed as described above, is able to make a sound output from the sound-sending section 2A of the speaker unit 2 pass therethrough, while the internal sponge 45, which is made of the low repulsion urethane foam for which the continuous bubble processing has not been performed, is not able to make a sound output from the sound-sending section 2A of the speaker unit 2 pass therethrough.

On the other hand, the ear pad 3, which is configured such that, in the cover sponge 42 in the form of a ring provided with a hole of the pad cover 40, the internal sponge 45 in the form of a ring provided with a hole of approximately the same size is stored, can make a sound output from the sound-sending section 2A of the speaker unit 2 pass through the two holes of the rings and the cloth 41 in the state of knit, and make the sound reach an ear of the user.

Furthermore, in the ear pad 3, since the low repulsion urethane foam is used for the internal sponge 45, and knit is used for the cloth 41 which abuts on the internal sponge 45 and is pressed to an ear of the user, the characteristics of being transformed slowly with respect to an external pressure applied to the internal sponge 45 as well as recovering slowly can be directly transmitted to an ear through the thin and soft cloth 41 in the state of knit.

Accordingly, when the left side headphone main body section 1 having the ear pad 3 attached thereto is fixed to the user, even if only a small lateral pressure can be expected, the left side headphone main body section 1 can absorb the ear figuration differences having individual differences of respective users through the internal sponge 45 and cloth 41 of the ear pad 3, and can give a more comfortable feeling and a more stable feeling to all the users when being fixed to the users.

Furthermore, since the internal sponge 45 made of the low repulsion urethane foam used for the ear pad 3 is provided with the characteristics of being transformed slowly with respect to an external pressure as well as recovering slowly, the internal sponge 45 can be matched to be attached firmly to the concavity and convexity of an ear which is different among ears due to the individual differences, the left side headphone main body section 1 can surely cover the clearance between the ear and the ear pad 3 as compared with that in the past, which can prevent a sound from leaking from the front surface side of the ear pad 3.

(1-5) Performance and Effect

Figure 14:
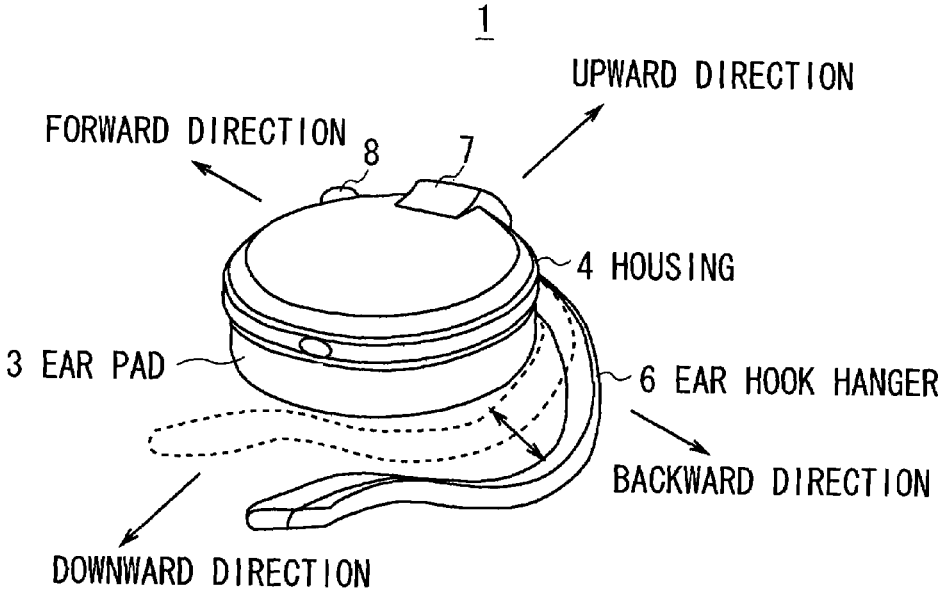
FIG. 14 shows a perspective view indicative of the pivot state of an ear hook hanger of the left side headphone main body section.

In above-described configuration, in the left side headphone main body section 1, as shown in FIG. 14, when the ear hook hanger 6 pivots through the rotational bearing 5, not shown, due to the biasing force to return the arm section of the ear hook hanger 6 to the original position, which is brought about when the arm section of the ear hook hanger 6 is shifted in a direction getting away from the housing 4, an ear of the user is sandwiched between the ear pad 3 and the arm section of the ear hook hanger 6.

Figure 15A:
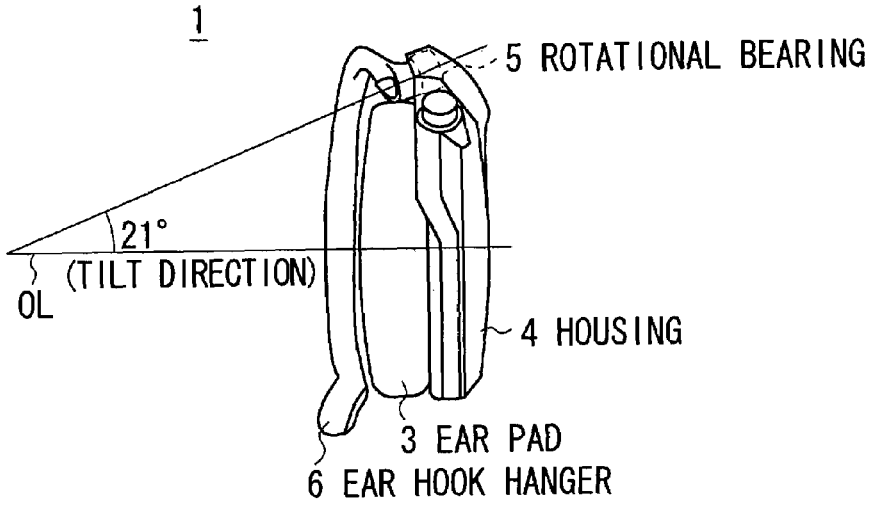
FIG. 15A and FIG. 15B show schematic views indicative of the ear hook hanger whose axis is inclined in two directions or in the tilt direction and in the twist direction.
Figure 15B:
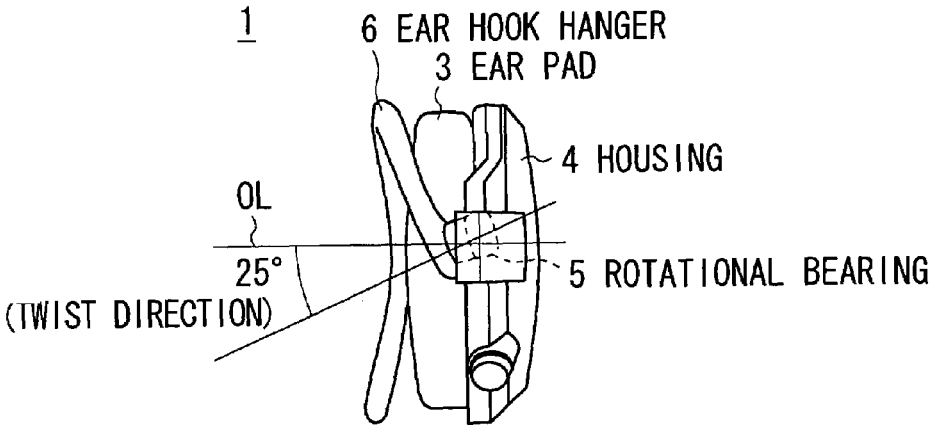

At this time, as shown in FIG. 15A and FIG. 15B, in the left side headphone main body section 1, when viewing it from the front side thereof, the ear hook hanger 6 is attached with an inclination of approximately 21 degrees in the tilt direction with respect to the normal line of the housing 4, while, when viewing it from the top side thereof, the ear hook hanger 6 is attached with an inclination of approximately 25 degrees in the twist direction with respect to the normal line of the housing 4, configuring a three-dimensional axis line which is formed by inclining the ear hook hanger 6 in two directions. Accordingly, when making the ear hook hanger 6 pivots through the rotational bearing 5, the arm section of the ear hook hanger 6 can be attached in accordance with the angle of an ear.

Figure 16B:
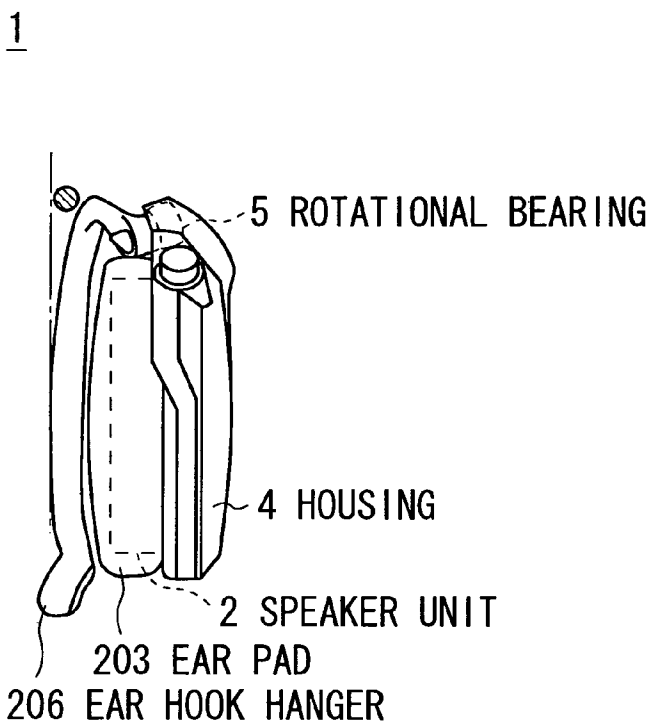
FIG. 16A and FIG. 16B show schematic views to describe the distance between the ear hook hanger and the rear part of an ear.
Figure 16A:
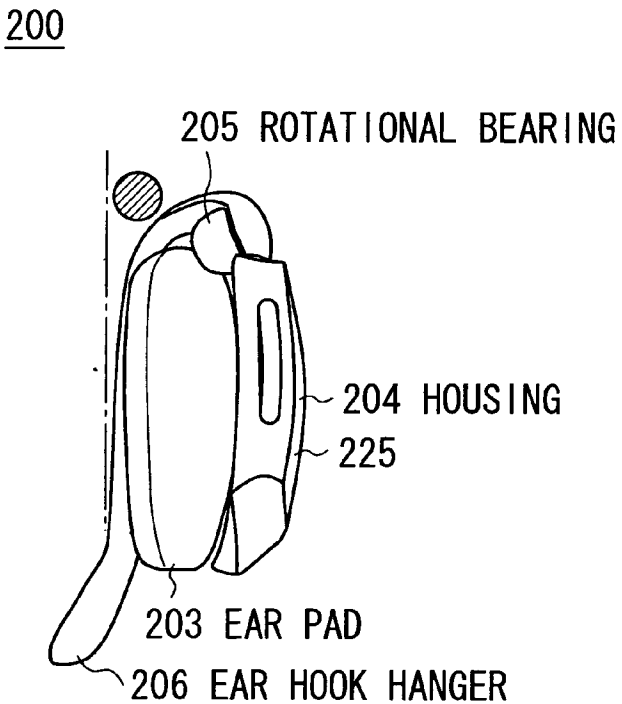

Next, the difference of the fixing state between a case in which a conventional left side headphone main body section 200 having an ear hook hanger 206 whose axis is inclined in one direction is fixed to the user, as shown in FIG. 16A, and a case in which the left side headphone main body section 1 having the ear hook hanger 6 whose axis is inclined in two directions according to an embodiment of the present invention is fixed to the user, as shown in FIG. 16B, will be verified.

In this case, in the conventional left side headphone main body section 200 having an ear hook hanger 206 whose axis is inclined in one direction (FIG. 16A), while a rotational bearing 205 that pivots and retains the ear hook hanger 206 is arranged at a quadrant of the side of an ear pad 203, since the direction of the rotational bearing 205 that pivots and retains the ear hook hanger 206 is arranged at a quadrant of the side of a face cap 225 of a housing 204, the ear hook hanger 206 rotates and comes into a quadrant of the ear pad 203 side from the face cap 225 side, drawing a large curve.

Accordingly, in the left side headphone main body section 200 having the ear hook hanger 206 whose axis is inclined in one direction (FIG. 16A), the space between the arm section of the ear hook hanger 206 and the rear part of an ear of the user is made large, which undesirably reduces the contact area of the arm section of the ear hook hanger 206 and the rear part of the ear.

On the other hand, in the left side headphone main body section 1 having the ear hook hanger 6 whose axis is inclined in two directions according to an embodiment of the present invention (FIG. 16B), since the rotational bearing 5 that pivots and retains the ear hook hanger 6 is arranged at a quadrant of the side of the ear pad 3 having the speaker unit 2 arranged at the inside thereof, and the direction of the rotational bearing 5 that pivots and retains the ear hook hanger 6 is arranged at a quadrant of the ear pad 3 side, the ear hook hanger 6 is directly arranged at a quadrant of the ear pad 3 side from the rotational bearing 5.

Accordingly, in the left side headphone main body section 1 having the ear hook hanger 6 whose axis is inclined in two directions (FIG. 16B), the space between the arm section of the ear hook hanger 6 and the rear part of an ear of the user is almost removed, which enlarges the contact area of the arm section of the ear hook hanger 6 and the rear part of the ear significantly. Thus, the retention capacity can be improved, and a more comfortable feeling and a more stable feeling are given to the user when the left side headphone main body section 1 is fixed to the user.

In addition, in the left side headphone main body section 1, as the pivot angle of the ear hook hanger 6 changes, the distances DM1 to DM3 from the surface of the ear pad 3 to the ear hook hanger 6 are changed (FIG. 8A to FIG. 8C), while the arm section of the ear hook hanger 6 is kept parallel with respect to the surface of the ear pad 3. Accordingly, even if the thicknesses of the ears ER1 to ear ER3 of the respective users are different from each other, a comfortable feeling can be given to the users when the left side headphone main body section 1 is fixed to the users.

Furthermore, in the left side headphone main body section 1, since the low repulsion urethane foam is used for the internal sponge 45 as the material, and thin soft knit is used for the cloth 41 which abuts on the internal sponge 45 and is pressed to an ear of the user as the material, with respect to the lateral pressure from an ear to be given to the internal sponge 45, the internal sponge 45 can be transformed slowly as well as recover slowly according to the figuration of the ear to be matched to the ear.

Accordingly, when the left side headphone main body section 1 is fixed to the user, through the internal sponge 45 and cloth 41 in the state of knit, the ear pad 3 can be matched to the figuration of an ear of the user, which can give a sufficient contact feeling and prevent a sound from leaking, and can concurrently give a more comfortable feeling.

Even in this case, since the pad cover 40 having the cloth 41 in the state of knit which is excellent in air permeability is used, the left side headphone main body section 1 can give a sufficient contact feeling and prevent a sound from leaking, and can concurrently prevent the pad cover 40 from getting hot and stuffy, and can further give a more comfortable feeling.

Under above-described configuration, it is possible to realize an excellent headphone of the behind-the-ear fixing type including the left side headphone main body section 1 and a right side headphone main body section which can give a more comfortable feeling and a more stable feeling to the user when being fixed to the user.

Figure 17:
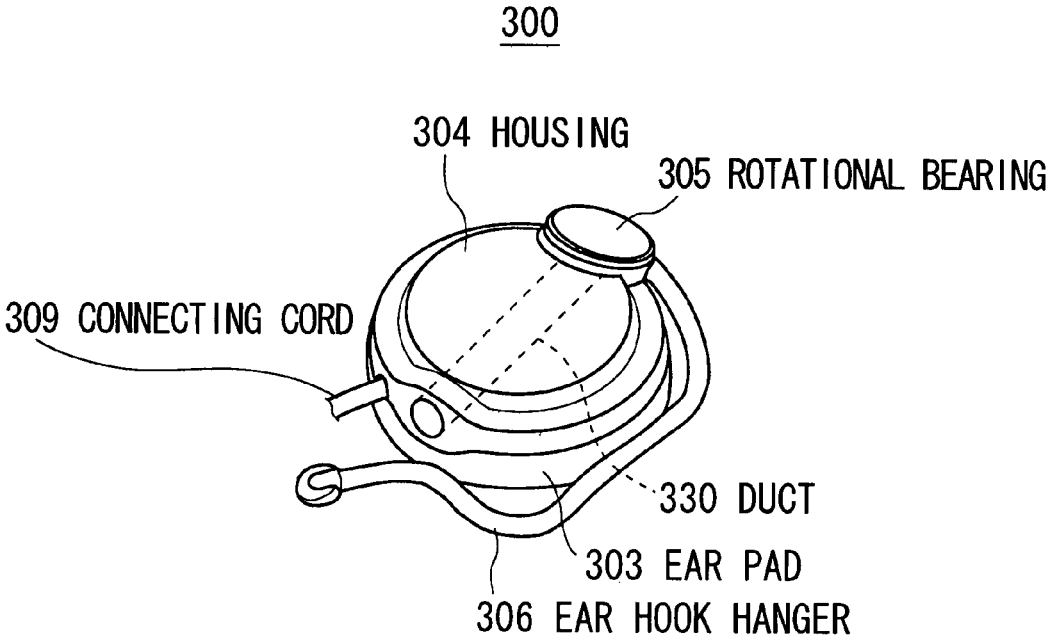
FIG. 17 shows a perspective view indicative of the configuration of a headphone main body section of the hanger-ear type according to the second embodiment.

(2) Second Embodiment (2-1) External Appearance Configuration of a Headphone Main Body Section in the Second Embodiment In FIG. 17, in which parts or components similar to those shown in FIG. 1A and FIG. 1B are indicated with the same reference numerals, a reference numeral "300" represents a left side headphone main body section to be fixed to a left ear configuring a headphone of the hanger-ear type according to the second embodiment. As the entire headphone, a right side headphone main body section to be fixed to a right ear, not shown, and the left side headphone main body section 300 which are of the same configuration and symmetric with each other are connected by a connecting cord 309.

In this case, in the left side headphone main body section 300 in the second embodiment, as the characteristics, a housing 304 has arranged therein not a cord-reeling mechanism to reel up the connecting cord 309 but a duct 330 that strengthens the bass, and the configuration of an ear hook hanger 306 is similar to that in the first embodiment, configuring a three-dimensional axis line which is formed by inclining the ear hook hanger 306 in two directions or in the tilt direction as well as in the twist direction through the rotational bearing 305.

The three-dimensional axis line, which is formed by inclining the ear hook hanger 306 in two directions, is similar to that of the ear hook hanger 6 in the first embodiment, and the detailed explanation of which is omitted here.

The duct 330 is adapted to shift the resonance frequency to a lower frequency band according to the diameter and length so as to strengthen the bass level. When the size of the duct becomes larger as much as possible, the bass can be strengthened to a sufficient level in a stable state.

Accordingly, also in the left side headphone main body section 300 in the second embodiment, having an axis which is inclined in two directions, when the ear hook hanger 306 is made to pivot, the ear hook hanger 306 can be attached along the rear side of an ear of the user.

In addition, also in the left side headphone main body section 300, as the pivot angle of the ear hook hanger 306 changes, the distance from the surface of the ear pad 303 to the arm section of the ear hook hanger 306 is changed, while the arm section of the ear hook hanger 306 is kept parallel with respect to the surface of the ear pad 303. Accordingly, even if the thicknesses of the ears of the respective users are different from each other, a comfortable feeling can be given to all the users when the left side headphone main body section 300 is fixed to the users.

Furthermore, since the configuration of the ear pad 303 of the left side headphone main body section 300 is similar to that of the ear pad 3 of the left side headphone main body section 1 in the first embodiment, it is possible to give a more comfortable feeling and a more stable feeling to the user when being fixed to the user as compared with that in the past.

(3) Other Embodiments

In the first and second embodiments, the ear hook hangers 6 and 306 being an elastic body made of synthetic resin respectively are used, to which the present invention is not restricted, and the ear hook hangers 6 and 306 made of material which is scarcely provided with the spring property may be used so long as the ear hook hangers 6 and 306 are matched to the figuration of an ear of the user to some extent when coming into contact with the ear.

Furthermore, in the first and second embodiments, with respect to the ear hook hangers 6 and,306, the inclination angle θ1 in the tilt direction is set to approximately 21 degrees, while the inclination angle θ2 in the twist direction is set to approximately 25 degrees, to which the present invention is not restricted, and the inclination angles θ1 and θ2 may be arbitrarily set up within a range from 10 to 45 degrees in the tilt direction as well as in the twist direction so long as the ear hook hangers 6 and 306 have an axis which is inclined in two directions respectively.

Moreover, in the first and second embodiments, a fixed type is described, in which, through the rotational bearings 5 and 305, with respect to the ear hook hangers 6 and 306, the inclination angle θ1 in the tilt direction is set to approximately 21 degrees, while the inclination angle θ2 in the twist direction is set to approximately 25 degrees, to which the present invention is not restricted, and there may be employed a configuration in which the direction of the rotational bearings 5 and 305 is changed, and the inclination angle θ1 in the tilt direction and the inclination angle θ2 in the twist direction can be finely adjusted according to the user.

Yet moreover, in the first and second embodiments, the ear pads 3 and 303 in which the pad cover 40 and internal sponge 45 are deposited by heat are used, to which the present invention is not restricted, and the ear pads 3 and 303 in which the pad cover 40 and internal sponge 45 are united in advance may be used, or, in case the internal sponge 45 is only stored in the pad cover 40 and they are not deposited by heat, a cover sponge made of polyurethane foam of the ester series may be used.

Yet moreover, in the first and second embodiments, the cover sponge 42 made of polyurethane foam of the ester series is used at the rear surface side of the pad cover 40, to which the present invention is not restricted, and the cloth 41 in the state of knit may be used similar to the front surface side of the pad cover 40, or the cover sponge 42 made of the low repulsion urethane foam which is similar to the material of the internal sponge 45 may be used.

Yet moreover, in the first and second embodiments, the pad cover 40 of the ear pads 3 and 303 is used for a headphone of the behind-the-ear fixing type or the hanger-ear type, to which the present invention is not restricted, and the pad cover 40 of the ear pads 3 and 303 may be used for a headphone of the sound-isolating type or headphones of other various types so long as an ear pad is necessary.

Yet moreover, in the first and second embodiments, the cloth 41 is used for the pad cover 40 of the ear pads 3 and 303, to which the present invention is not restricted, and other various kinds of synthetic resin fabric material such as polyester resin and polyurethane resin in the state of cloth or a paper may be used instead of the cloth 41.

Yet moreover, in the first and second embodiments, the left side headphone main body sections 1 and 300 of a headphone of the behind-the-ear fixing type are configured by the headphone section 29 as a headphone section and the ear pad 3 as an ear pad, to which the present invention is not restricted, and the left side headphone main body sections 1 and 300 of a headphone of the behind-the-ear fixing type may be configured by a headphone section and an ear pad of other various figurations and configurations.

The headphone of the behind-the-ear fixing type according to the embodiments of the present invention can also be applied to various electronic devices provided with the music reproduction function other than the portable music player such as a cellular phone and a small-sized mobile computer.

It should be understood by those skilled in the art that various modifications, combinations, sub-combinations and alterations may occur depending on design requirements and other factors insofar as they are within the scope of the appended claims or the equivalents thereof.

What is claimed is:

1. A headphone comprising:

a headphone section that has a sound-sending section of a speaker unit arranged at the front surface side thereof, and has its rear surface side covered by a housing; and an ear pad that covers the sound-sending section of the speaker unit;

wherein, in the ear pad, a porous elastic body of low repulsion is covered by a pad cover, and wherein the pad cover that stores the porous elastic body of low repulsion includes a polyurethane foam for which the continuous bubble processing has been performed and a cloth, and the cloth is attached to the front surface side thereof which abuts on a ear of the user.

2. The headphone according to claim 1, wherein the ball drop resilience of the porous elastic body of low repulsion is 20% or less.

3. The headphone according to claim 1, wherein the porous elastic body of low repulsion is made of urethane foam of low repulsion, and is in the form of a ring which is provided with a hole at the center thereof.

4. The headphone according to claim 1, wherein the porous elastic body of low repulsion is deposited by heat at the inside of the pad cover.

5. An ear pad comprising:

a porous elastic body of low repulsion in the form of a ring which is provided with a hole at the center thereof; and a pad cover that covers the porous elastic body of low repulsion;

wherein the pad cover includes a polyurethane foam for which the continuous bubble processing has been performed and a cloth, and the cloth is attached to the front side thereof which abuts on a ear of the user.

* * * * *